US007217171B2

(12) United States Patent
Hsu

(10) Patent No.: US 7,217,171 B2
(45) Date of Patent: May 15, 2007

(54) TOY WITH MOVING HEAD

(75) Inventor: Sheng-Hung Hsu, Kaohsiung Hsien (TW)

(73) Assignee: Gemmy Industries Corporation, Coppell, TX (US)

( * ) Notice: Subject to any disclaimer, the term of this patent is extended or adjusted under 35 U.S.C. 154(b) by 69 days.

(21) Appl. No.: 11/230,661

(22) Filed: Sep. 21, 2005

(65) Prior Publication Data

US 2007/0077856 A1 Apr. 5, 2007

(51) Int. Cl.
*A63H 3/00* (2006.01)
*G09F 19/08* (2006.01)

(52) U.S. Cl. ..... 446/300; 446/301; 446/330; 446/338; 40/414

(58) Field of Classification Search ..... 40/411, 40/414; 446/268, 298, 300, 301, 330, 338
See application file for complete search history.

(56) References Cited

U.S. PATENT DOCUMENTS 5,870,842 A * 2/1999 Ogden et al. ..... 40/411
5,870,843 A * 2/1999 Hsu et al. ..... 40/411
6,135,848 A * 10/2000 Hou ..... 446/353
6,416,380 B1 * 7/2002 Li-Wen ..... 446/353

* cited by examiner

*Primary Examiner*—John A. Ricci
(74) *Attorney, Agent, or Firm*—Rosenberg, Klein & Lee

(57) ABSTRACT

A toy with a moving head has a seat, a front and a rear support respectively mounted on the seat, and a gear box provided between the front and rear supports. A series of gears and a series of actuating wheels are rotatably mounted in the gearbox. A first motor is connected to the gearbox and a head is connected to the gearbox. When the motor drives the gearbox, the head is raised and lowered by a set of actuating wheels and the head is shaken by a second set of actuating wheels. The jaw of the head also opens and closes to present a dynamic effect to attract people.

5 Claims, 7 Drawing Sheets

TOY WITH MOVING HEAD

BACKGROUND OF THE INVENTION

1. Field of the Invention

The present invention relates to a toy with a moving head, and more particularly to a toy, which can raise, lower or shake its head to attract attention with its dynamic effect.

2. Description of the Related Art

At present, many kinds of dynamic toys exist in the market, such as shaking Christmas trees and toy fish with moving tails. However, in certain environments, these toys are limited by their dynamic effect.

Therefore, the invention provides a toy with a moving head to mitigate or obviate the aforementioned problems.

SUMMARY OF THE INVENTION

The main objective of the present invention is to provide a toy with a moving head to present a dynamic effect and attract attention.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
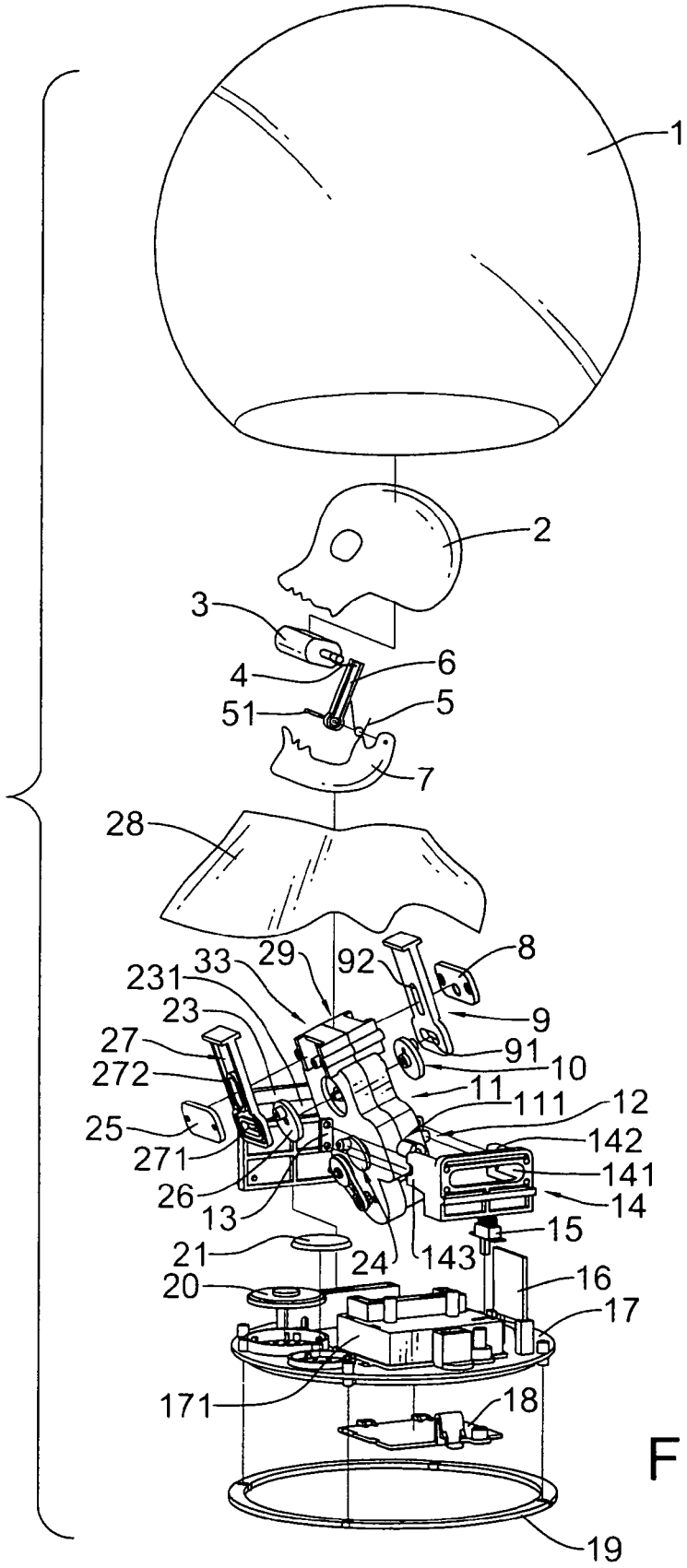
FIG. 1 is an exploded perspective view of a toy with a moving head in accordance with the present invention.
Figure 2:
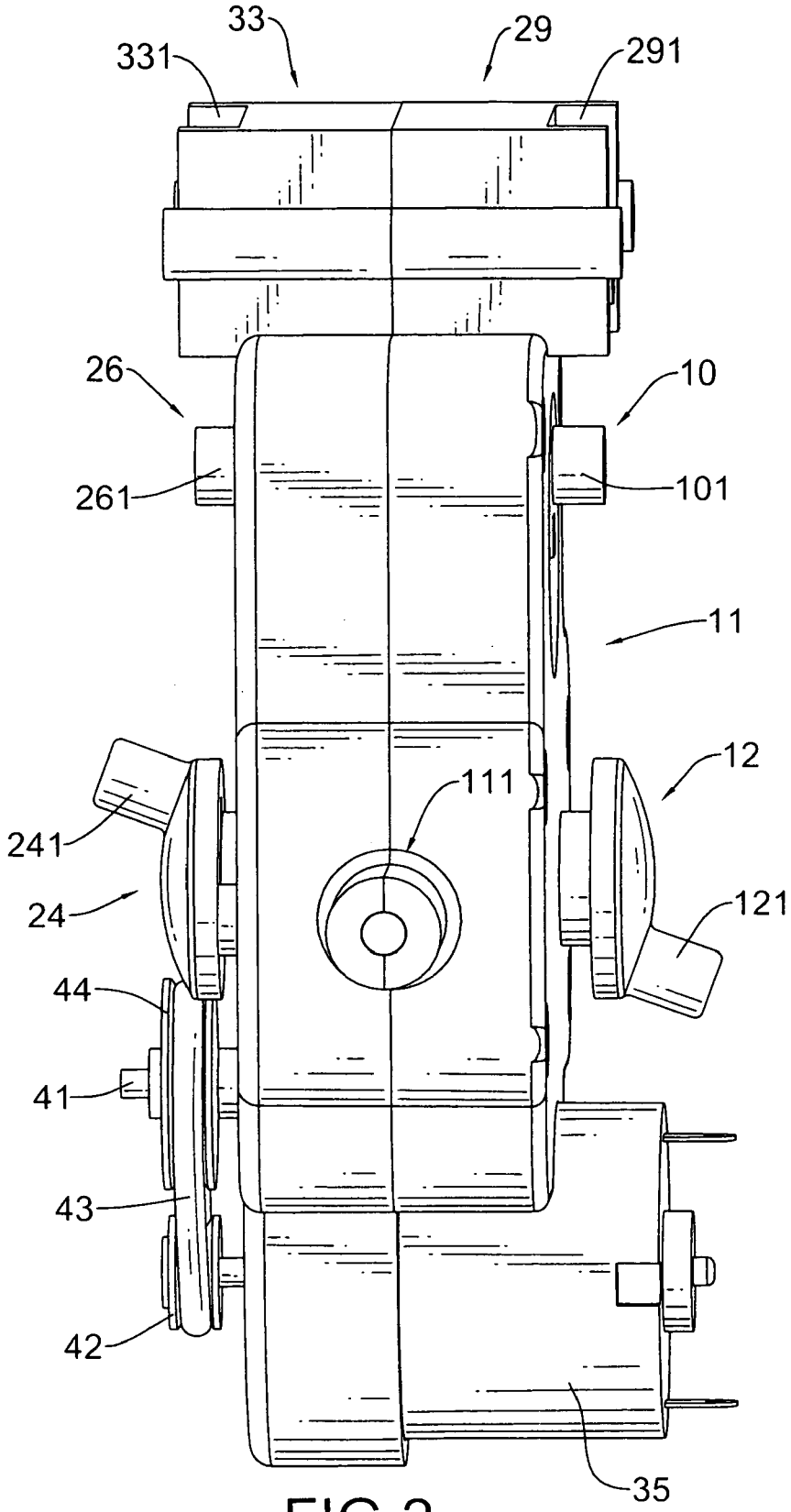
FIG. 2 is an end view of a gearbox of the toy with a moving head in accordance with the present invention.
Figure 3:
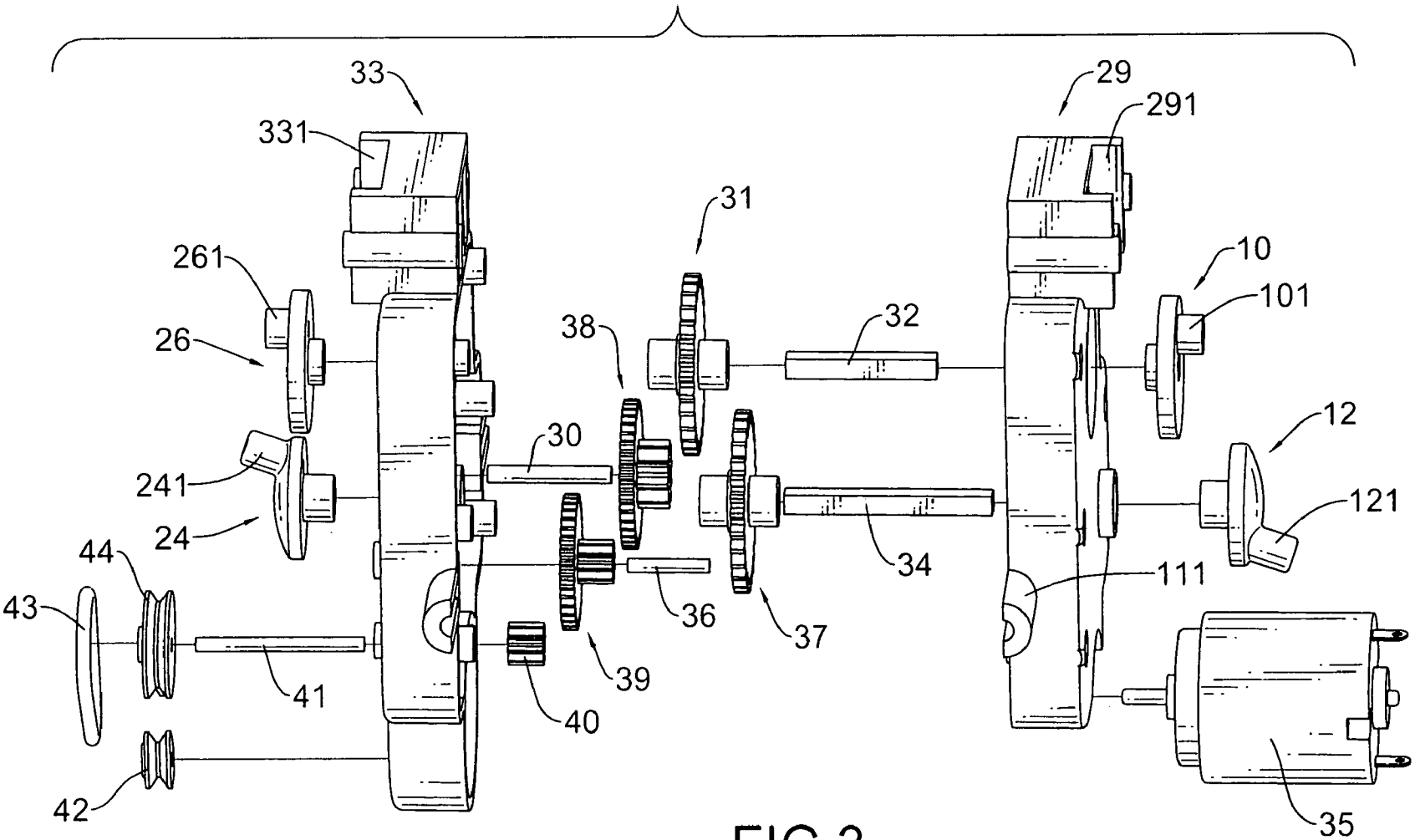
FIG. 3 is an exploded perspective view of the gearbox of the toy with a moving head in accordance with the present invention.
Figure 4:
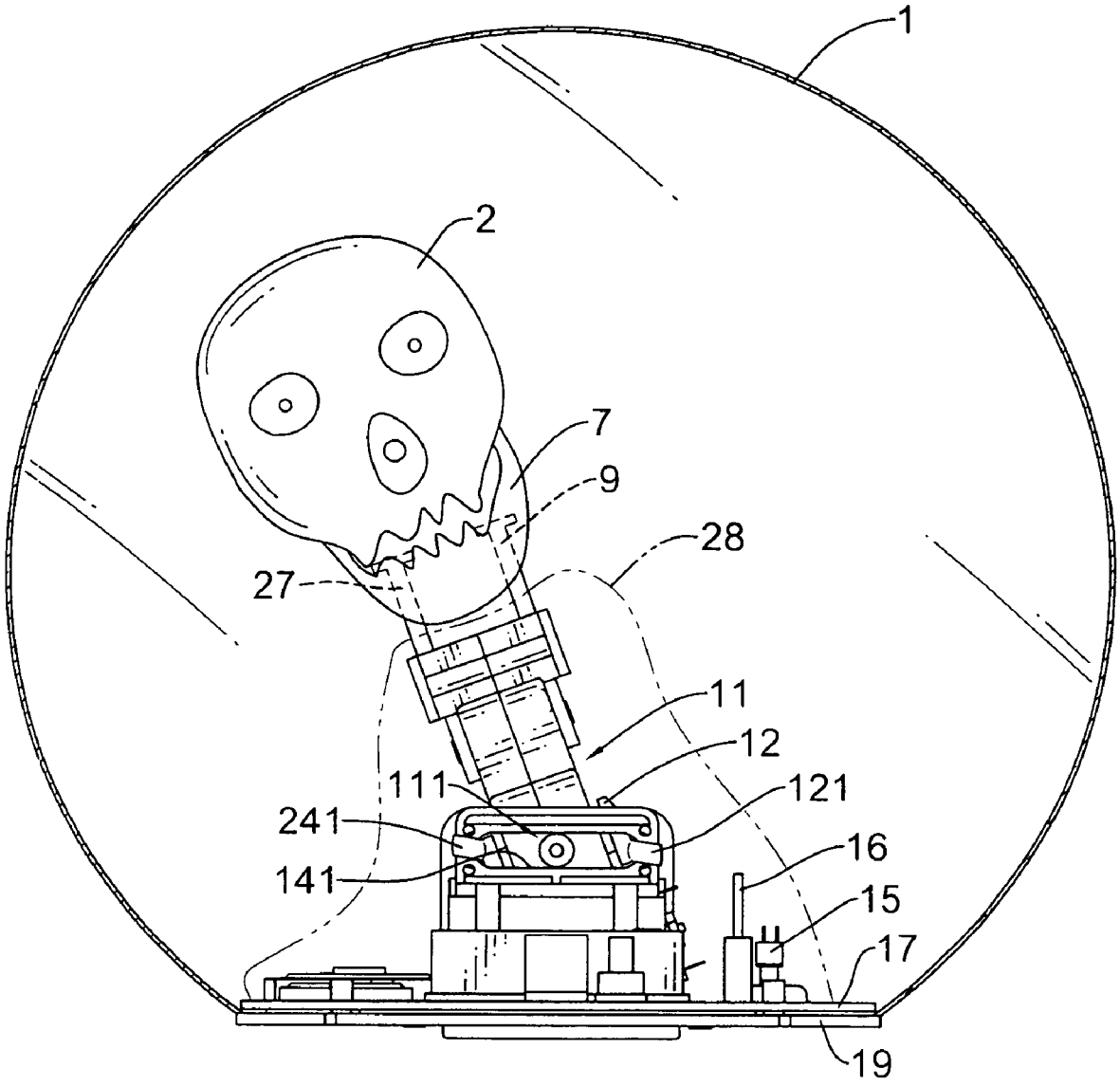
FIG. 4 is a front view of the toy with a moving head in accordance with the present invention.
Figure 5:
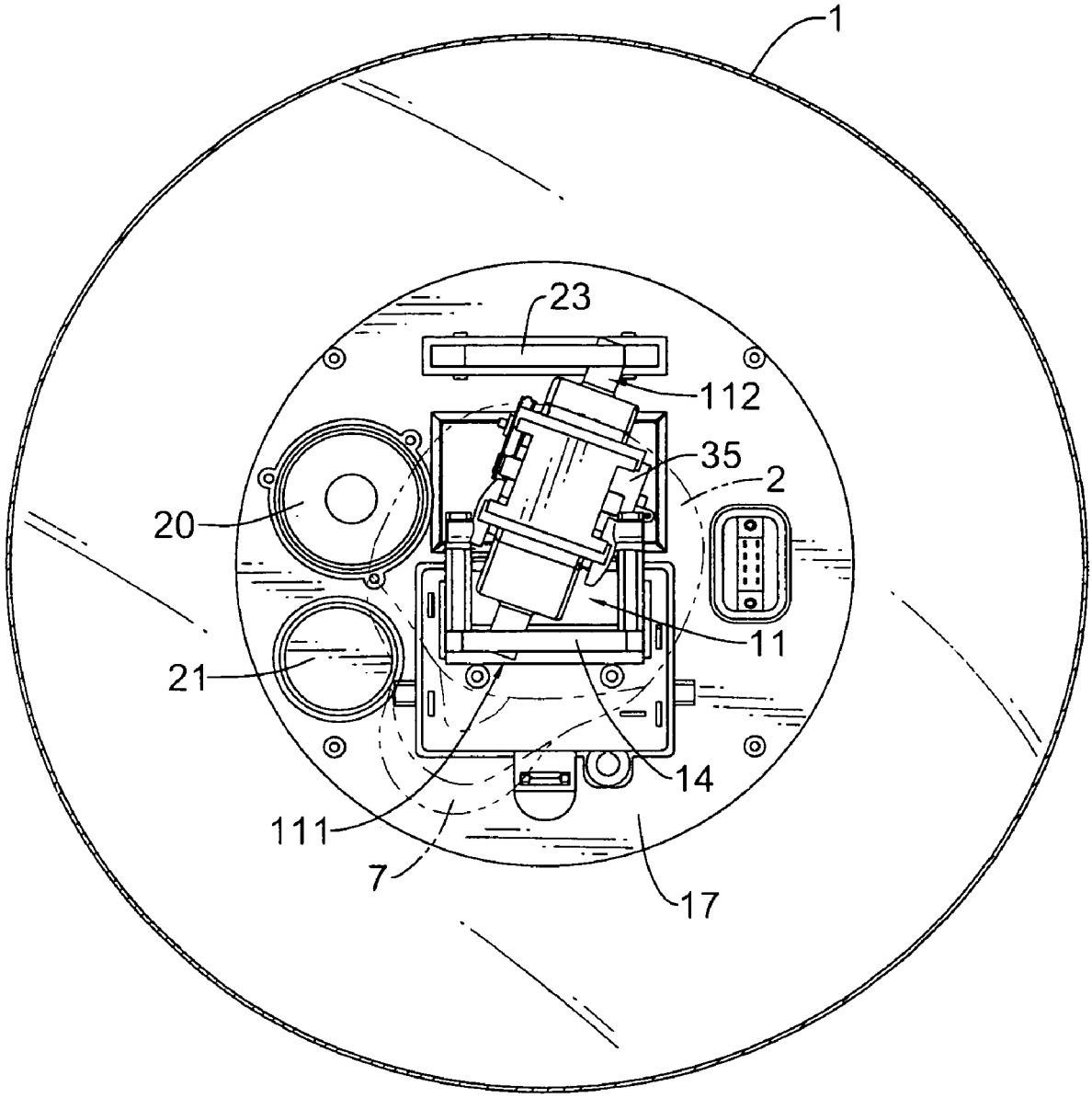
FIG. 5 is a top view of the toy with a moving head in accordance with the present invention.
Figure 6:
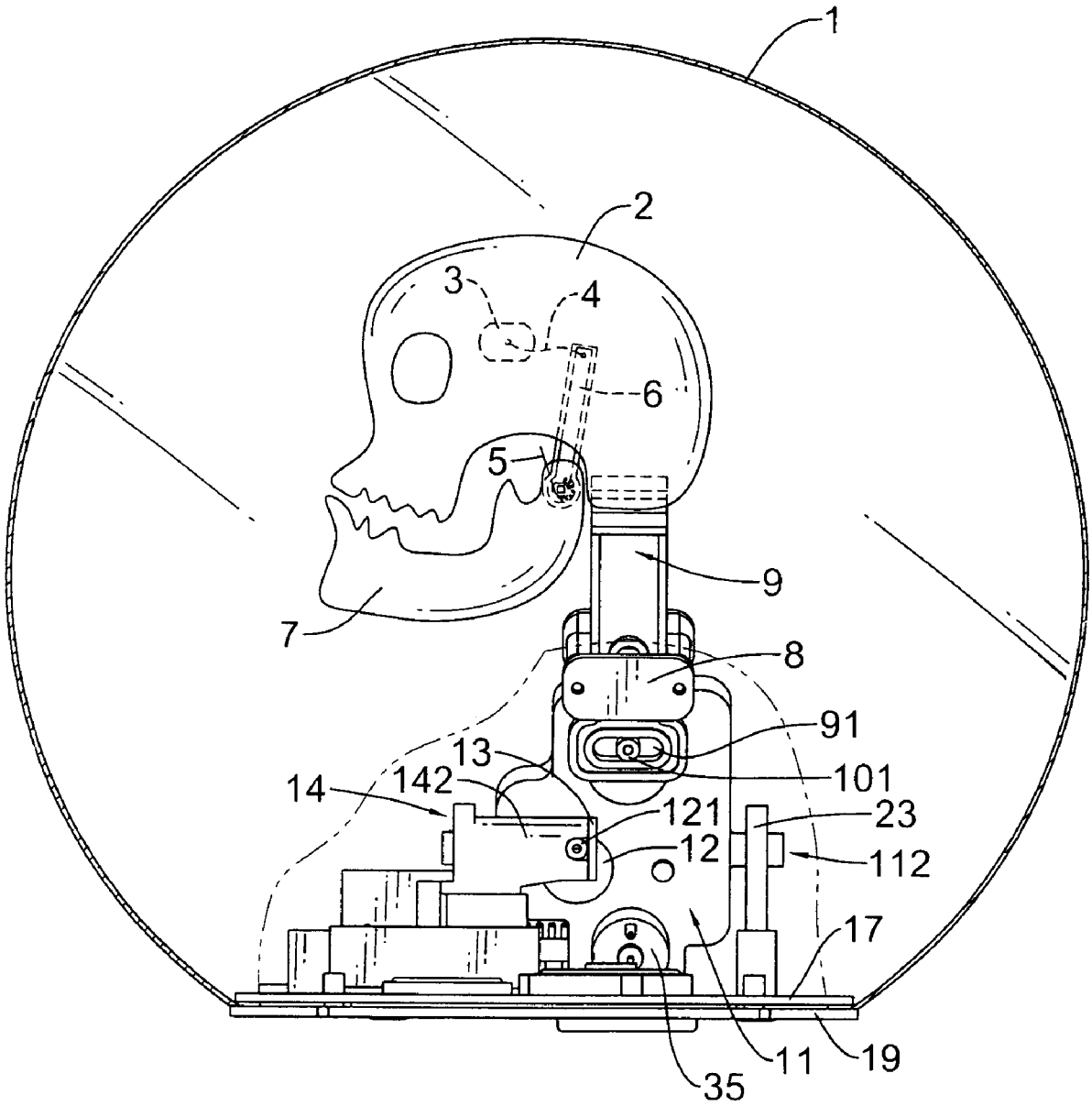
FIG. 6 is a side view of the toy with a moving head in accordance with the present invention.

With reference to FIGS. 1–6, a toy with a moving head has a seat (17) provided in a lower end thereof, a gearbox (11), a head (2), and a transparent sphere (1).

The seat (17) has a battery box (171) provided on a top end thereof, a switch (15) mounted adjacent to the battery box (171), a buzzer (21) and a speaker (20) abutting the battery box (171), and a circuit board (16) adjacent to the switch (15) and electrically connected to the battery box (171), the switch (15), the buzzer (21) and the speaker (20).

A front support (14) is provided in a front end of the seat (17), and a front slot (141) is transversely defined in the front support (14). A right support arm (142) and a left support arm (143) extend out of the two sides of the front support (14), respectively. Two circular grooves are defined respectively at the ends of the support arms (142, 143). A rear support (23) is provided in a rear end of the seat (17) and a rear slot (231) is transversely defined in the rear support (23).

With reference to FIGS. 1, 2, 3 and 5, the gear box (11) has a right shell (29) and a left shell (33). A first protrusion (111) is integrally formed at a front end of the gear box (11) and inserted into the front slot (141) and a second protrusion (112) is integrally formed at a rear end of the gear box (11) and inserted into the rear slot (231). A right sliding passage (291) is defined in an upper periphery of the right shell (29) and a left sliding passage (331) is defined in an upper periphery of the left shell (33) and corresponds to the right sliding passage (291). Two guide pegs are formed respectively inside the right and left sliding passages (291, 331).

A first motor (35) abuts the lower periphery of the right shell (29) and a series of gears, a series of axles and a series of tubes are interconnected and mounted in the gear box (11) and connected to the first motor (35). The series of the gears has a first gear (40), a second gear (39), a third gear (38), a fourth gear (37), and a fifth gear (31). The series of the axles comprises a first axle (41), a second axle (36) and a third axle (30). The series of the tubes comprises a first tube (32) and a second tube (34). A first end of the first tube (32) extends out of the right shell (29) to be connected to an upper right actuating wheel (10) and a second end of the first tube (32) extends out of the left shell (33) to be connected to an upper left actuating wheel (26). An upper right eccentric lug (101) is formed eccentrically on the upper right actuating wheel (10) and an upper left eccentric lug (261) is eccentrically formed on the upper left actuating wheel (26).

A first end of the second tube (34) extends out of the right shell (29) to be connected to a lower right actuating wheel (12), and a second end of the second tube (34) extends out of the left shell (33) to be connected to a lower left actuating wheel (24). A lower right skewed lug (121) is formed eccentrically on the lower right actuating wheel (12) and a lower left skewed lug (241) is formed eccentrically on the lower left actuating wheel (24). The lower right and left skewed lugs (121, 241) are inserted into and pivoted relative to the circular grooves in the right and left support arms (142, 143) of the front support (14), and two end plates (13) are mounted at the ends of the support arms (142, 143) to hold the skewed lugs (121, 241) in the grooves.

A drive pulley (42) abuts the periphery of the left shell (33) and is connected to the first motor (35) via a central axle of the first motor (35). The first axle (41) is rotatably mounted in the left shell (33). A transfer pulley (44) abuts the periphery of the left shell (33) and is connected to a first end of the first axle (41). A drive belt (43) connects the drive pulley (42) to the transfer pulley (44). A second end of the first axle (41) is inserted into the left shell (33) and the first gear (40) is inserted onto the second end of the first axle (41). The second axle (36) is provided in the gear box (11) and the second gear (39) is rotatably mounted on the second axle (36). The third axle (30) is provided in the gear box (11) and the third gear (38) is rotatably mounted on the third axle (30). The fourth gear (37) is mounted on the second tube (34) and the fifth gear (31) is mounted on the first tube (32). Hence, all the gears are interconnected to each other and rotate simultaneously when driven by the first motor (35).

A right sliding plate (9) is received into the right sliding passage (291) and a left sliding plate (27) is received into the left sliding passage (331). A right horizontal slot (91) is transversely defined in the right sliding plate (9) and receives the upper right eccentric lug (101). A left horizontal slot (271) is transversely defined in the left sliding plate (27) and receives with the upper left eccentric lug (261). A right vertical slot (92) is defined in the right sliding plate (9) and a left vertical slot (272) is defined in the left sliding plate (27). The right and left sliding plates (9, 27) are mounted such that the guide pegs in the sliding passages (291, 331) are received in the right and left vertical slots (92, 272). A right cover (8) and a left cover (25) are mounted over the sliding passages (291, 331) to hold the sliding plates (9, 27) within the sliding passages (291, 331).

The head (2) has a chamber defined in an interior thereof and a second motor (3) is provided in the chamber. A lever (6) is connected to a rod (51), which is pivotally mounted to an inner wall of the chamber. Hence, the lever (6) can pivot relative to the chamber. A spring (5) is connected to the rod (51) and the free end of the lever (6) is connected to an end of a tether (4). The other end of the tether (4) is attached to the axle of the second motor (3). A jaw (7) is connected at the two ends of the rod (51). The battery box (171) is covered with a battery cap (18). The mechanical elements of the present invention are covered with a cloth (28), except for the head (2), thereby hiding the gearbox.

Figure 7:
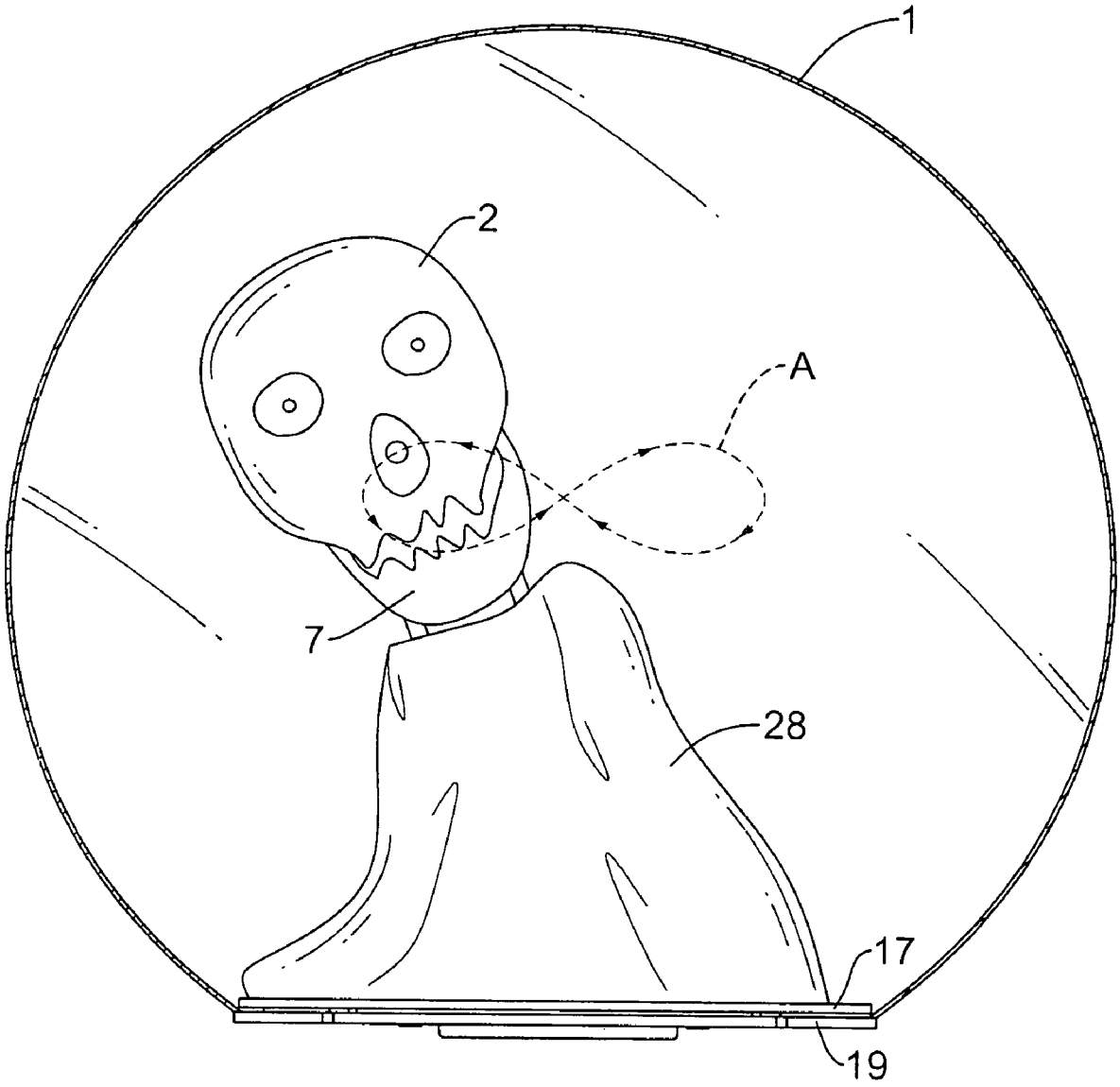
FIG. 7 is a front view of the toy with a moving head in accordance with the present invention in operation.

With reference to FIGS. 1, 3, 6 and 7, when the second motor (3) operates, the tether (4) is drawn up and to wind around the axle of the second motor (3) thereby pivotally the lever (6). This in turn rotates the rod (51) causing the jaw (7) to open. When the second motor (3) stops, the resilient force of the spring (5) forces the tether (4) to unwind from the axle of the second motor (3), returning the jaw (7) to its original closed position. With the alternating operation of the second motor (3), the jaw (7) can be alternately opened and closed. The series of the gears are rotated by the first motor (35). The upper actuating wheels (10, 26) are rotated by the first tube (32) to reciprocate the sliding plates (9, 27), thereby causing the head (2) to alternately rise and fall.

The transparent sphere (1) has an open end defined in a lower end thereof and the open end is mounted around a periphery of the seat (17). A collar (19) is provided on the periphery of the seat (17) to position the transparent sphere (1) on the seat (17).

Furthermore, with the rotation of the lower actuating wheels (12, 24) driven by the second tube (34), the gear box (11) can swivel between the front support (14) and the rear support (23). In addition to the foresaid action, the speaker (20) and the buzzer (21) are added to present a lived and dynamic effect of the present invention.

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A toy with a moving head comprising a seat having a battery box, a switch, a buzzer, a speaker, a circuit board electrically connected to the battery box, the switch, the buzzer and the speaker, a front support provided on a front end of the seat and having a front slot transversely defined in the front support, and a right and a left support arm formed respectively on two sides of the front support and in a same direction, and a rear support provided on a rear end of the seat and having a rear slot transversely defined therein;

a gear box attached to the seat and having a right shell and a left shell combined together, a first protrusion integrally formed in a front end of the gear box and inserted into the front slot, a second protrusion integrally formed in a rear end of the gear box and inserted into the rear slot, a right sliding passage defined in an upper periphery of the right shell, a left sliding passage defined in an upper periphery of the left shell and corresponding to the right sliding passage, a first motor abutted a periphery of the gear box, a series of gears, a series of axles and a series of tubes interconnected and mounted in the gear box and respectively connected to the first motor, wherein the series of the tubes has a first tube and a second tube, and a first end of the first tube extending out of the right shell and connected to an upper right actuating wheel and a second end of the first tube extending out of the left shell and connected to a upper left actuating wheel, wherein the upper actuating wheels have eccentric transverse lugs, a first end of the second tube extending out of the right shell and connected to a lower right actuating wheel and a second end of the second tube extending out of the left shell and connected to a lower left actuating wheel, wherein the lower actuating wheels have eccentric skewed lugs formed thereon, and a right sliding plate slidably received into the right sliding passage and a left sliding plate slidably received into the left sliding passage, with a right horizontal slot defined in the right sliding plate to receive the upper right eccentric lug, and a left horizontal slot defined in the left sliding plate to receive the upper left eccentric lug;

a head operatively connected to the gear box and having a chamber defined in an interior thereof, a second motor provided in the chamber, a lever with a first end connected to a rod, which is pivotally connected to an inner wall of the chamber, and a second end connected to the second motor, a spring connected to the rod and one end of the lever, a jaw connected at two sides of the rod; and a transparent sphere attached to the seat and having an open end mounted around a periphery of the seat, and a collar provided on the periphery of the seat, whereby the transparent sphere is positioned on the seat.

2. The toy with a moving head as claimed in claim 1, wherein the series of the gears comprises a first gear, a second gear, a third gear, a fourth gear and a fifth gear;

the series of the axles comprises a first axle, a second axle and a third axle;

a drive pulley abuts the periphery of the left shell and is connected to a central axle of the first motor;

the first axle is rotatably mounted in the left shell;

a transfer pulley abuts the periphery of the left shell and is connected to a first end of the first axle;

a drive belt mounted between and connects the drive pulley to the transfer pulley;

a second end of the first axle is inserted into the left shell and the first gear is inserted into the second end of the first axle;

the second axle is provided in the gear box and the second gear is rotatably mounted on the second axle;

the third axle is provided in the gear box and the third gear is rotatably mounted on the third axle;

the fourth gear is mounted on the second tube and the fifth gear is mounted on the first tube, whereby all the gears are interconnected to each other and rotate simultaneously when driven by the first motor.

3. The toy with a moving head as claimed in claim 1, wherein two circular grooves are defined respectively at the ends of the right and left support arms of the front support;

a lower right skewed lug is formed on the lower right actuating wheel and a lower left skewed lug is formed on a lower left actuating wheel;

the right and left skewed lugs are respectively inserted into and pivoted relative to the circular grooves; and two end plates are mounted at the ends of the support arms to hold the skewed lugs in the grooves.

4. The toy with a moving head as claimed in claim 3, wherein a piece of cloth is provided under the head to cover the gear box.

5. The toy with a moving head as claimed in claim 3, wherein a right cover is mounted over the right sliding plate and a left cover is mounted over the left sliding plate, whereby the right and the left sliding passages are respectively sealed.

* * * * *